US005973673A

United States Patent [19]

Hodson

[11] Patent Number: 5,973,673

[45] Date of Patent: Oct. 26, 1999

[54] CURSOR CONTROL DEVICE

[75] Inventor: Peter Hodson, Stepney, Australia

[73] Assignee: Automation and Process Control Services Pty, Ltd., Stepney, Australia

[21] Appl. No.: 08/865,504

[22] Filed: May 29, 1997

[30] Foreign Application Priority Data

May 30, 1996 [AU] Australia ..... PO0170

[51] Int. Cl.[6] ..... G09G 5/08

[52] U.S. Cl. ..... 345/158; 345/156; 345/157; 345/161; 463/37; 74/471 XY; 250/231.16

[58] Field of Search ..... 345/161, 156, 345/157, 158; 463/36, 37, 38; 74/471 XY; 250/221, 229, 231.13, 231.16

[56] References Cited

U.S. PATENT DOCUMENTS

| | | | |
|---|---|---|---|
| 3,016,421 | 1/1962 | Harmon | 178/19 |
| 3,811,047 | 5/1974 | Shragal | 250/221 |
| 4,092,532 | 5/1978 | Hayes | 250/221 |
| 4,250,378 | 2/1981 | Mutton | 250/221 |
| 4,533,827 | 8/1985 | Fincher | 250/221 |
| 4,607,159 | 8/1986 | Goodson et al. | 250/221 |
| 4,748,323 | 5/1988 | Holiday | 250/221 |
| 4,994,669 | 2/1991 | Stern | 250/229 |
| 5,117,102 | 5/1992 | Mitchell | 250/229 |
| 5,132,672 | 7/1992 | Clark | 345/163 |
| 5,675,359 | 10/1997 | Anderson | 345/161 |

*Primary Examiner*—Jeffery A. Hofsass
*Assistant Examiner*—Julie B. Lieu
*Attorney, Agent, or Firm*—Marshall & Melhorn

[57] ABSTRACT

A control device suitable for controlling the position of a cursor on a computer display. The device includes at least a pair of optical radiation sources irradiating a spaced away pair of optical radiation detectors. Interposed between the sources and detectors is an elongate member moveable transverse to the paths of radiation between sources and detectors. The member is opaque to the radiation and it obscures radiation detected by the detectors dependant upon its position. Thus the outputs of the detectors vary with the position of the member. By comparing the outputs of the detectors, typically subtracting one form the other, the sign of the result indicates the direction the member has been moved and the magnitude can give an indication of the extent of the movement. In a further form, a second pair of sources and a second pair of detectors are provide in similar manner to the first except that the radiation paths are co-planar but at ninety degrees to each other. Then one set of detectors can indicate X axis movement and the other Y axis movement. In one form the member is axially moveable and by comparing changes in outputs of respective detectors this axial movement can be detected and used to indicate Z axis movement or control button clicks. The device can be manufactured to be suitable for use in industrial environments where some previously known control devices could not be used.

24 Claims, 6 Drawing Sheets

RTS
TX
SENSEXA
SENSEXB
SENSEYA
SENSEYB
LEDSB
LEDSA
LEDBOOST
VCO
OSCIN
RA3/VREF
RA4/T
RB0/I
RB1
RB2
RB3
RB4
RB5
RB6
RB7
OSCOUT
/RESET
VSS
VDD
/RES
MC 34064
LP2950CZ-5.0
VI
VO
GND
DTR
PS2 PWR
PS2 CLK
PS2 DATA

SERIAL CONNECTION TO PC

PS2 CONNECTION TO PC

CURSOR CONTROL DEVICE

FIELD OF INVENTION

The invention disclosed herein relates to a control device. The control device can be used to translate manual manipulation of an elongate member into movement of a real or virtual object as will become apparent hereafter.

The control device can be used to effect remote control of a semi-robotics machine. A mechanised arm is an example of such a machine that might be controlled using the device disclosed herein.

In one application the device is a cursor control device for use in controlling a cursor on a computer display screen or the like. It will be appreciated that herein the term computer is, unless clear from the context, to be understood in a broad sense including any computerised or similar arrangement including a display and a cursor displayed thereon. Accordingly, apparatuses such as cathode ray oscilloscopes, plant control systems, and the like utilising interactive cursor function control fall within the broad meaning of computer used herein.

BACKGROUND OF THE INVENTION

Cursor control devices are known to take a number of forms which include track balls, joy sticks and the well known computer mouse.

The cursor control device herein described is applicable to situations where other cursor control devices are difficult, inconvenient or in use are of limited value. Whilst not limiting the application of the invention, the situation of plant control in industrial environments will be used as an example to illustrate the problems experienced by prior known devices and the advantages or uses of the invention disclosed herein.

Computerised control of industrial plants is becoming more wide spread with the development of related technology. Such equipment can often provide for automation or semi-automation of industrial plants. Further, in other cases, and may be in conjunction with the last two mentioned applications, computerised control can provide alternative means to controlling machinery or permit robotics machinery to perform dangerous functions that were otherwise conducted by people.

Part of the advantages of computerisation is that many circumstances can be accommodated and complex functions can be performed. With this increased versatility and complexity goes the need for a simple, versatile and effective control of a computerised plant.

As in the case of general computer usage, cursor control and selection of functions by interactive action between an operator and displayed functions would be advantages in industrial application. Known control devices provide such simple, versatile and effective control in many situations but in many industrial applications there are problems.

A problem often encountered with industrial application of computerised equipment lies in the nature of the industrial environment. Often such environments are dusty, damp, and otherwise difficult environments for reliable use of known control devices. Often grime gets into the known control devices and prevents their efficient operation.

Another problem with mouse devices is that suitable space is need to operate them. This space is preferably flat and of sufficient size to allow easy and single movement of the mouse to effect full display transversion of the cursor. Obviously such a flat surface easily be covered with dust settling from the air. This exasperates the prior mentioned problem of ingress of grime.

A further requirement for cursor control device is that it needs to be convenient to use. In such difficult environments mouse devices may not be easy to use as an operator may have dirty hands which make the use difficult or have to wear safety gloves which reduce tactile control.

Some known cursor control devices are difficult or impossible to effectively seal or proof against some industrial environments. It is desirable in many industrial control applications to effective seal a cursor control devices and so permit the versatility and power of computerised plant to be controlled effectively.

It is a proposed object of this invention to provide a cursor control device to obviate or minimise at least one of the aforementioned problems, or at least provide the public with a useful choice.

SUMMARY OF THE INVENTION

The invention may be said to reside, not necessarily in the broadest or only form, in a cursor control device for controlling the location of a cursor on a computer display screen including:

a pair of sources each adapted to emit radiation;

a pair of detectors each positioned to substantially exclusively detect radiation emitted from a respective one of the sources;

two substantially parallel radiation detection paths each between one of said pair of sources and a respective detector, said paths together defining a field of radiation;

electronic means electrically connected to the sources and the detectors;

an elongate member movably attached to a mounting means by an end and made of material opaque to the radiation and being adapted to be manually moveable, said elongate member being positioned so that the field is intersected by the elongate member in a manner whereby movement of the elongate member effects variation in the intensity of the radiation detected by the detectors; and, each detector being adapted to produce a signal proportional to the intensity of the detected radiation, the signal being supplied to the electronic means which is adapted to produce an output signal indicative of the relative radiation intensity detected by one detector compared with the other detector thereby indicating the required movement of the cursor.

The invention may alternatively be said to reside, again not necessarily in the broadest or only form, in a control device for determining displacement of an elongate member with a longitudinal axis passing along its length, which device comprising:

support means;

a first pair of radiation detectors supported in fixed relationship by the support means and each radiation detector capable of providing an output signal of value dependant upon the intensity of detected radiation;

a first pair of radiation sources supported in fixed relationship by the support means and each radiation source capable of emitting radiation, the first pair of radiation sources capable of irradiating the first pair of radiation detectors, each radiation detector being spaced along a respective one of a first pair of detection paths from a respective one of the radiation sources and receptive to radiation emanating from substantially exclusively the respective one of the radiation sources, the radiation between respective radiation sources and radiation detectors forming a first field of radiation;

the elongate member being supported by the support means and intersecting the first field of radiation and which in a neutral position the longitudinal axis is substantially centrally located between the detection paths, the elongate member being opaque to the radiation and movable transverse the first field of radiation and the detection paths thereby capable of variably obstructing radiation emanating from a one of the radiation sources irradiating a respective one of the radiation detectors and thereby varying the level of the output signal of the respective radiation detector;

electronic means connected to and capable of powering the radiation sources, the electronic means connected to each output signal of the radiation detectors and capable of processing the outputs of the radiation detectors by a process including the step of subtracting the output signal of one of the first pair of radiation detectors from the output signal of the other of the first pair of radiation detectors to provide a first device output signal.

In a preferred form, the manipulable member is an elongate member with a portion suitable for manual manipulation and the detection paths are substantially parallel.

In a preferred form, the first output signal takes one of a number of values, greater than two, dependant upon the subtraction of the output signal of one of the first pair of radiation detectors from the output signal of the other of the first pair of radiation detectors. In a digital system it may be desired for the device output signal, which can be a digital signal of a number of bits length, to take a value from a predetermined set of values dependent upon the result of the subtraction.

In another preferred form, the sign of the first output signal indicates the direction of movement of the elongate member and the magnitude of the first output signal indicates the extent of the movement of the elongate member. Whilst this relationship may or may not be linear, it will be appreciated that an elongate member pivoted hard to one side would indicate fast movement in the desired direction and little rotation of the elongate member to the said side would indicate slow movement in the desired direction.

In another preferred form the sign of the subtraction of output signals of the radiation detectors is used to indicate the direction of movement and the magnitude indicates the extent of the movement. These can be combined to form the device output signal. In the case where digital electronics are being used the sign of the subtraction may be used to set or clear a bit in a digital signal of a number of bits length.

In a preferred form, when the subtraction of the output signal of one of the first pair of radiation detectors from the output signal of the other of the first pair of radiation detectors exceeds a predetermined threshold value then the signal is indicative of desired movement in a respective direction. By including a threshold test prior to generating the device output signal small differences can be ignored as might occur due to unintentional movement of the elongate member.

Preferably movement of the elongate member is limited. In a preferred form, when the elongate member is moved to an extreme extent one or other detection paths are obscured to a greatest extent.

According to a preferred form, each source is adjacent to a detector and distal the other source such that the respective detection paths travel in opposite directions. This form minimises cross talk between parallel detection paths. Further, it permits the use of sources with divergent radiation beams and detectors with broad acceptance fields of views typified by common and inexpensive sources and detectors.

This arrangement permits sources such as LED's and photo diodes to be used which commonly have quite broad fields of views. By placing a detector along side a source wider transmission angles of sources and detection view of detectors can be used compared with the arrangement of where the pair of sources are adjacent and facing across the field the pair of detectors are adjacent.

In a preferred form, the support of the elongate member relative to the support means permits axial movement along the longitudinal axis of the elongate member and longitudinal movement of the elongate member in a first direction brings an end of the elongate member to bear against and activate a push button thereby generating a control signal.

The invention may alternatively be said to reside, again not necessarily in the broadest or only form, in a control device comprising:

support means;

a first and second pair of radiation detectors supported in fixed relationship by the support means and each radiation detector capable of providing an output signal of value dependant upon the intensity of detected radiation;

a first and second pair of radiation sources supported in fixed relationship by the support means and each radiation source capable of emitting radiation, the first pair of radiation sources capable of irradiating the first pair of radiation detectors, each radiation detector being spaced along a respective one of a first pair of detection paths from a respective one of the radiation sources and receptive to radiation emanating from substantially exclusively the respective one of the radiation sources, the radiation between respective radiation sources and radiation detectors forming a first field of radiation;

the second pair of radiation sources capable of irradiating the second pair of radiation detectors, each radiation detector being spaced along a respective one of a second pair of detection paths from a respective one of the radiation sources and receptive to radiation emanating from substantially exclusively the respective one of the radiation sources, the radiation between respective radiation sources and radiation detectors forming a second field of radiation which is transverse to the to the first field of radiation;

an elongate member with a longitudinal axis passing along its length, the elongate member being supported by the support means and intersecting the first and second fields of radiation and which in a neutral position the longitudinal axis is substantially centrally located between the first and second detection paths, the elongate member being opaque to the radiation and movable transverse the first and second fields of radiation and the detection paths thereby capable of variably obstructing radiation emanating from a one of the radiation sources irradiating a respective one of the radiation detectors and thereby varying the level of the output signal of the respective radiation detector;

electronic means connected to and capable of powering the radiation sources, the electronic means connected to each output signal of the radiation detectors and capable providing a first device output signal by a process including the step of subtracting the output signal of one of the first pair of radiation detectors from the output signal of the other of the first pair of radiation detectors and providing a second device output signal by a process including the step of subtracting the output signal of one of the second pair of radiation detectors from the output signal of the other of the second pair of radiation detectors.

It will be appreciated that in a preferred form the device output signal is indicative of a desired direction of cursor movement.

In a preferred form, the fields are co-planar and transverse one to the other at substantially ninety degrees. In another preferred form, the fields transverse one over the other at substantially ninety degrees. Having the fields substantially at ninety degrees to each other and either co-planer or parallel planar means that the device outputs for the fields can correspond to X and Y axis. If desired the fields can be at an angle other than ninety degrees but in such a case the processing of the respective detector outputs will need to be adjusted to suit.

According to another preferred form, the support of the elongate member relative to the support means permits axial movement along the longitudinal axis of the elongate member, the transverse width of the elongate member varies along the length of the elongate member and such longitudinal movement of the elongate member within the fields of radiation effects an alteration in the radiation detected by the detectors and thereby the signals therefrom and the control device output signals produced by the electronic means. This variation in the width of the elongate member can be used in a variety of ways to affect further control of, for example, the cursor and computer functions some of which are indicated below.

Preferably the cursor control device is adapted so that longitudinal movement of the elongate member along its longitudinal axis effects generation of a control signal. In preference the longitudinal movement of the elongate member co-acts with a push button thereby generating the control signal. This permits depression, for example, of the elongate member to act against a push button. Such a button can be seal against ingress of grime by sealing means sealing the elongate member.

In an alternative preferred form the longitudinal movement of the elongate member within the fields effects an alteration in the radiation detected by the detectors and thereby the signals therefrom and the electronic means generates the control signal. In this manner the function of a known mouse button can be emulated or achieved without the need for a push button. In a preferred form the elongate member has one or more steps in its transverse width along its length.

In one preferred form the control signal indicates cursor movement in a represented further dimension. In this manner a preferred form permits a computer to represent three dimensional cursor control.

In a preferred form the elongate member has one or more steps in its transverse width along its length. Such steps effect the detected intensity of the radiation falling upon the detectors and may be used to emulate a mouse click or movement in a third dimension.

According to one preferred form, the support means includes flat spring means supported between spaced portions of the support means transverse to the longitudinal axis of the elongate member, and the elongate member being attached substantially centrally to the flat spring means. In one preferred form, the elongate member is attached by an end to the flat spring means. In another preferred form, the elongate member is attached part way along its length to the flat spring means. The use of a flat spring has the effect of biasing the elongate member in a neutral position substantially perpendicular to the spring. This can thus act to auto centre the control device when the elongate member is not being held to one side. In the neutral position the control device can typically provide a signal indicating no desired movement of, for example, a cursor.

In a preferred form, the electronic means includes analog to digital conversion means, digital processor means and digital memory means, each output signal of the radiation detectors being converted by the analog to digital conversion means to a respective digital representation and the digital processor means producing the first device output signal by a process including the step of subtracting the output signal of one of the first pair of radiation detectors from the output signal of the other of the first pair of radiation detectors and the second device output signal by a process including the step of subtracting the output signal of one of the second pair of radiation detectors from the output signal of the other of the second pair of radiation detectors. In a preferred form, the digital processor means produces the first and second device output signals by a process including the step of selecting a value from a look up table dependant upon the respective result of the respective subtractions of the radiation detector outputs.

In another preferred form, the support of the elongate member by the support means permits axial movement along the longitudinal axis of the elongate member, the transverse width of the elongate member varies along the length of the elongate member and such longitudinal movement of the elongate member within the fields of radiation effects an alteration in the radiation detected by the detectors and thereby the signals therefrom, the electronic means produces a control device output signal indicative of axial movement of the elongate member by processing the output signals of the radiation detectors in a process including the steps of sampling and storing the representations of the outputs of the radiation detectors, comparing samples of the outputs of the radiation detectors with respective previously stored representations, determining whether the outputs of the radiation detectors have increased or decreased and, if so, producing the control device output signal indicative of axial movement of the elongate member. In a preferred form, the processing of output signals of the radiation detectors by the electronic means includes the step of, when axial movement of the elongate member is determined, summing the representations of the output signals of the radiation detectors and producing the control device output signal indicative of axial movement of the elongate member dependant upon the result of the summation.

It will be appreciated that the configuration and the characteristics of the sources and the detectors are such that each source radiates to a single detector. Whilst it is preferred that each axis is sensed using a pair of detectors and a respective pair of sources it will be appreciated that providing the above requirement is met then more that two sources and respective detectors could be used.

BRIEF DESCRIPTION OF THE DRAWINGS

To assist in the understanding of the invention preferred embodiments will now be described with reference to the accompanying drawings.

To further assist understanding a copy of source code for a micro controller is attached hereto as Appendix 1.

DESCRIPTION OF THE INVENTION

Figure 1:
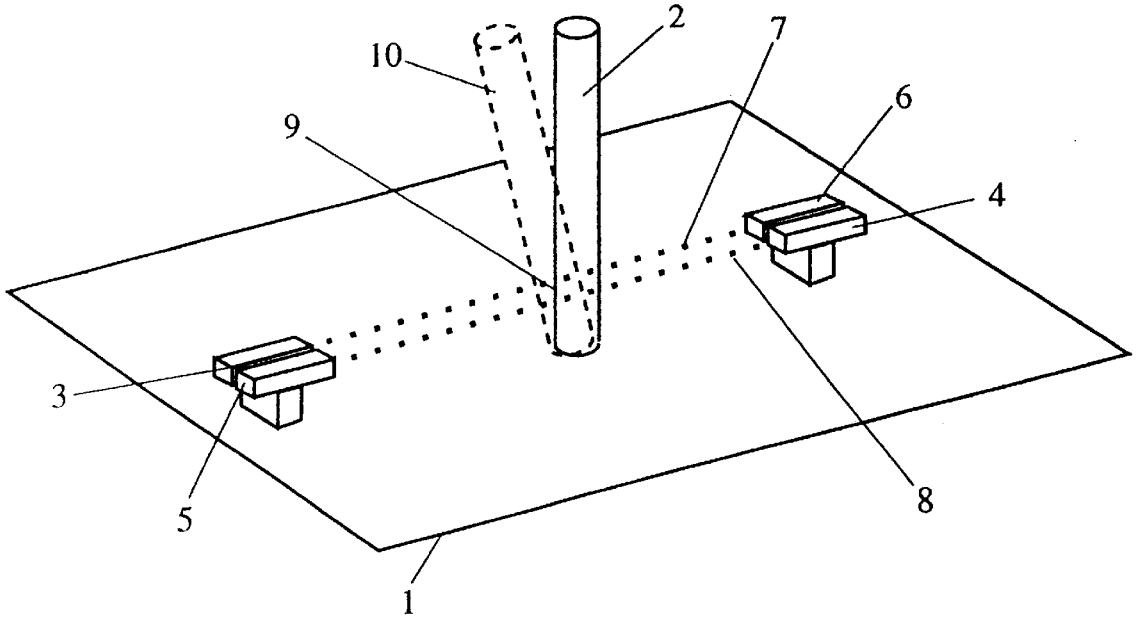
FIG. 1 illustrates the concept of the invention in schematic form.

The underlying concept of one aspect of the invention can be seen from FIG. 1 which for clarity of explanation has been simplified. It will be further appreciated that this discussion of the invention is not intended to limit the invention.

Without limiting the broad concept of the invention it is convenient at this point to discuss the nature of the radiation. It is expected that electromagnetic radiation will be the most preferred form of radiation but other forms may be useful such as sound. This radiation can be any suitable form such as, but not limited to, light. It will be appreciated that LED's may be used for the radiation sources and photo diodes or phototransistors may be the radiation detectors. It will be appreciated what is required is that radiation from the sources is detected by the detectors and variations in the intensity of the detected radiation may be discernible and conveniently detected.

In broad terms, there is provided a control device for determining displacement of a manipulable member 2 with a longitudinal axis passing along its length, which device comprising:

support means 1;

a first pair of radiation detectors 5 and 6 supported in fixed relationship by the support means and each radiation detector capable of providing an output signal of value dependant upon the intensity of detected radiation;

a first pair of radiation sources 3 and 4 supported in fixed relationship by the support means and each radiation source capable of emitting radiation, the first pair of radiation sources capable of irradiating the first pair of radiation detectors, each radiation detector being spaced along a respective one of a first pair of detection paths 7 and 8 from a respective one of the radiation sources and receptive to radiation emanating from substantially exclusively the respective one of the radiation sources, the radiation between respective radiation sources and radiation detectors forming a first field of radiation;

the manipulable member 2 being supported by the support means 1 and intersecting the first field of radiation and which in a neutral position the longitudinal axis is substantially centrally located between the detection paths, the manipulable member being opaque to the radiation and movable transverse the first field of radiation and the detection paths thereby capable of variably obstructing radiation emanating from a one of the radiation sources irradiating a respective one of the radiation detectors and thereby varying the level of the output signal of the respective radiation detector;

electronic means connected to and capable of powering the radiation sources, the electronic means connected to each output signal of the radiation detectors and capable of processing the outputs of the radiation detectors by a process including the step of subtracting the output signal of one of the first pair of radiation detectors from the output signal of the other of the first pair of radiation detectors to provide a first device output signal.

In more detailed terms, in FIG. 1 there is base or support means 1 to which is pivotally attached at an end 11 of a manipulable member, an elongate member 2, which can be considered as a joy stick of the device. The joy stick 2 is of radiation opaque material.

Either side of the joy stick 2 are a pair of radiation sources (LED's) 3 and 4 and radiation detectors (phototransistors) 5 and 6. Each pair of LED's 3 and 4 and phototransistors 5 and 6 are opposite and face the other pair. The phototransistors 5 and 6 are adapted to detect the light emitted by the LED's 3 and 4. Between each pair are two parallel beams or paths of light 7 and 8. The configuration is such that a line though an axis of the joy stick 2 when vertical is symmetrically straddled by the paths of pairs of LED's 3 and 4 and phototransistors 5 and 6.

The joystick 2 can be moved transverse to the beams 7 and 8.

Assuming that both LED's 3 and 4 are emitting the same intensity of light and the joystick 2 is centrally and vertically positioned then each phototransistor 4 and 5, assuming identical characteristics, will produce the same output level for the detected light. This level will depend upon the width of the part 9 of the joystick 2 obstructing the light beams 7 and 8.

If the joystick 2 is held at an angle to the vertical as illustrated in the dotted form 10, then beam 7 is more obstructed relative to beam 8 and so the detected level of phototransistor 5 will be different to that of phototransistor 6. Phototransistor 5 will detect more light. Likewise if the joystick 2 was held in the other direction phototransistor 6 will detector more light relative to phototransistor 5.

In this manner output levels of the phototransistors 5 and 6 can indicate the position of the joystick 2. Further, the levels can be combined, for example, by subtracting one signal from the other to give a positive or negative signal indicative of the direction the joy stick 2 is held.

It will be appreciated that the dimension of and allowed travel of the joystick 2 and the configuration of it and the pair of LED's 3 and 4 and phototransistors 5 and 6 has bearing upon the detected light intensity. For example, if the joystick 2 can be held so that neither beam 7 and 8 is obstructed then combining the output signals of the phototransistors 5 and 6 could indicate that the joystick is centrally located. However such an anomaly can be corrected by comparing the detected light levels which should be higher than when in the central joystick location. There beams are both at least in part obscured and so the detected light levels is lower. It may be necessary to repeatedly track movement of the joystick 2 to ensure correct direction is indicated.

Figure 8:
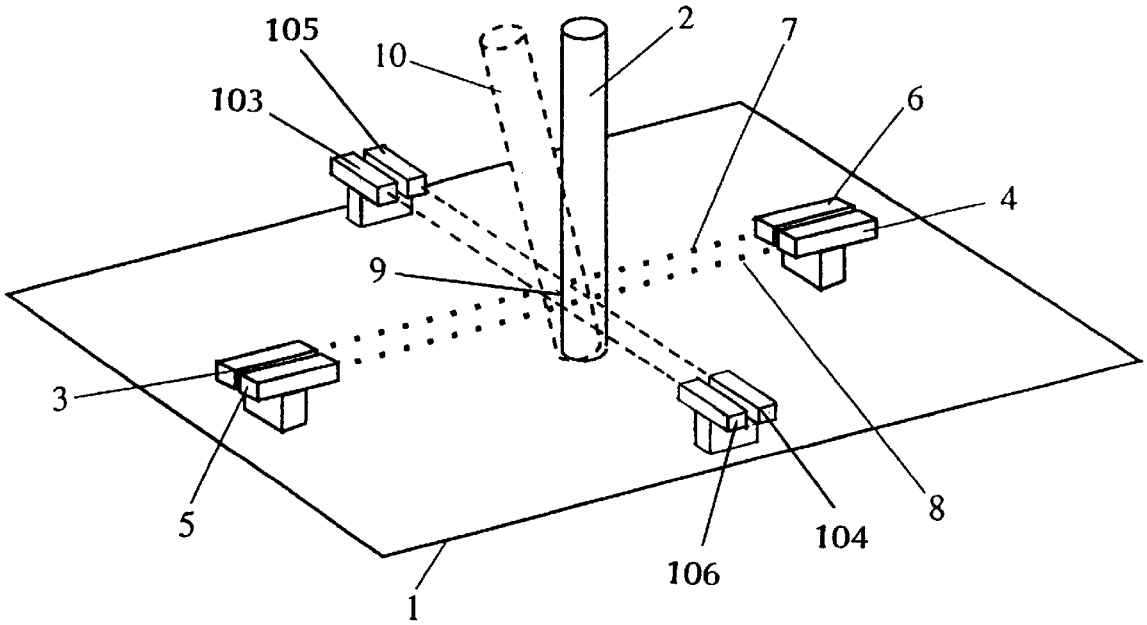
FIG. 8 illustrates an alternate embodiment of the invention in schematic form.

Conceptually it will be appreciated that placing a second pair of phototransistors and LED's each side of the joystick so that their beams intersect beams 7 and 8, preferably at 90°, then relative X and Y directions and movements may be determined. In this manner it will be appreciated that the normal movement control functions of a computer mouse can be achieved. Conceptually it will be appreciated that placing a second pair of phototransistors 105 and 106 and LED's 103 and 104 each side of the joystick so that their beams intersect beams 7 and 8, preferably at 90°, then relative X and Y directions and movements may be determined. See FIG. 8. In this manner it will be appreciated that the normal control functions of a computer mouse can be achieved.

It will also be appreciated that variations in the beam intensities detected by the phototransistors can be achieved in other ways. The above discussion has assumed that the joy stick 2 is pivoted at an end 11 and cannot axially move relative to the base 1.

Figure 2:
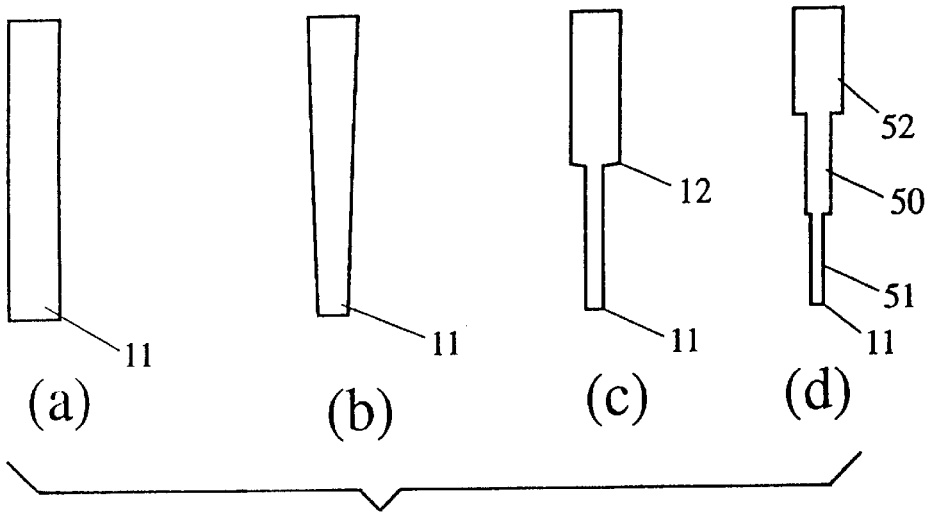
FIG. 2 illustrates different embodiments of the elongate member in schematic form.

As illustrated the joy stick 2 is cylindrical in shape and in FIG. 2(*a*) a side view is shown.

However, if the joystick 2 can move in the direction of its vertical axis then further advantages can be obtained. For example, pushing the joy stick 2 down could bring it to actuate a push button so permitting mouse clicks to be made.

Further, if the joystick 2 has a tapered profile as shown in FIG. 2(*b*) then variation in the detected beam intensities can be effected. This may permit the invention to effect control in a third or Z direction.

Also, if the joy stick 2 has a stepped profile as illustrated in FIG. 2(*c*) then pushing the joy stick 2 down so that the beams are transversed by the step portion 12 will effect a marked valiation in the detected beam intensities. This can be used with suitable signal processing to effect a mouse click.

A joy stick 2 with a number of steps, such as illustrated in FIG. 2(*d*) could also be used to effect Z axis control. Without axial displacement the paths or beams can or are intersected by portion 50 of the joy stick 2. When the joy stick 2 is axially displaced upward or downward the beams are intersected by portions 51 or 52 respectively.

By tracking the recent levels of the detected outputs of phototransistors 5 and 6 changes due to axial displacement of the joy stick can be determined. Should both outputs of phototransistors 5 and 6 change by substantially the same amount or the respective changes be of the same sign, that is both increased or decreased, then the joy stick has been moved axially. Where axial movement has occurred, the summation of the changes experienced by detected outputs of phototransistors 5 and 6 can be used to indicate the extent of axial movement.

When the joy stick is tilted axial movement can result in one output being increased or decreased relatively more than the other output and should the tilt be increased this effect can be greater. Should it be desired the extent of tilt in this way can be used to compensate for apparent greater axial movement due to the amount of tilt.

Finally, the determination of axial movement is dependant upon a previous sampling of the outputs of the radiation sources. When the sampling is updated and the joy stick is not moved the determination process above would incorrectly indicate no axial movement and so no desired movement in the Z axis. However, this can be compensated by storing the last desired Z axis control output and supplying this to the computer. The last desired Z axis value stored would be updated every time that axial movement of the joy stick is determined.

Having discussed the concept behind the invention in simplified terms the preferred embodiment will now be discussed with reference to FIGS. 3, 4, 5, 6 and 7.

Figure 3A:
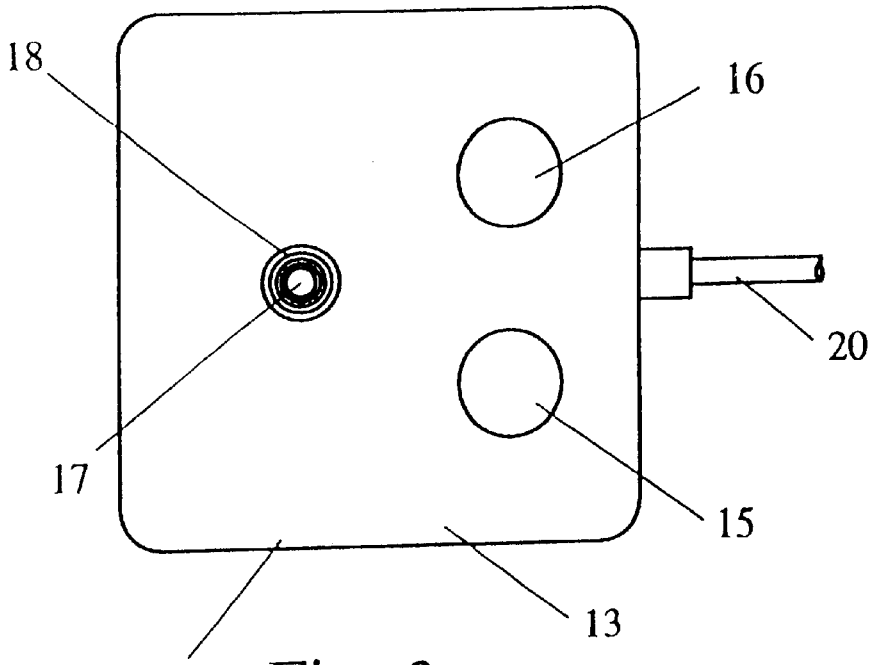
FIG. 3 illustrates views of a first preferred embodiment.
Figure 3B:
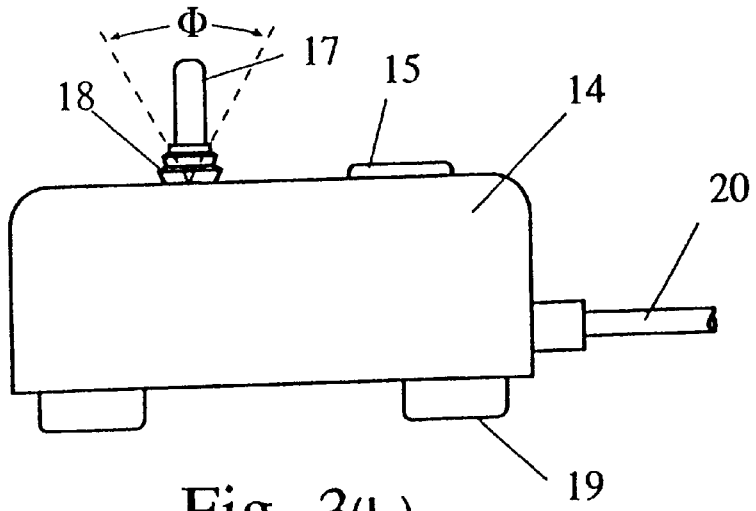

In FIG. 3(*a*) a top view of the preferred embodiment is illustrated. In FIG. 3(*b*) a side view of the preferred embodiment is shown. The preferred embodiment is a remote cursor control device intended to be connected to a computer.

The device 13 has a protective box 14 in which electronic circuits and mechanical portions are contained. There are two push buttons 15 and 16 respectively used to effect left and right mouse button clicks. There is a joy stick 17 which within the device 13 has an arc of permitted movement of $\phi$ which in the preferred embodiment is about 60°. To provide a flexible seal about the joy stick 17 and between the box 14 is an elastomer boot 18. This permits the movement whilst restricting ingress of environmental contaminants such as dust and moisture into the box 14. There are also provided elastomer feet, one illustrated as 19, which limit sliding movement of the device 13 when operated upon a flat surface. Cable 20 provides electrical connection to a computer, typical via serial or mouse port.

Figure 4:
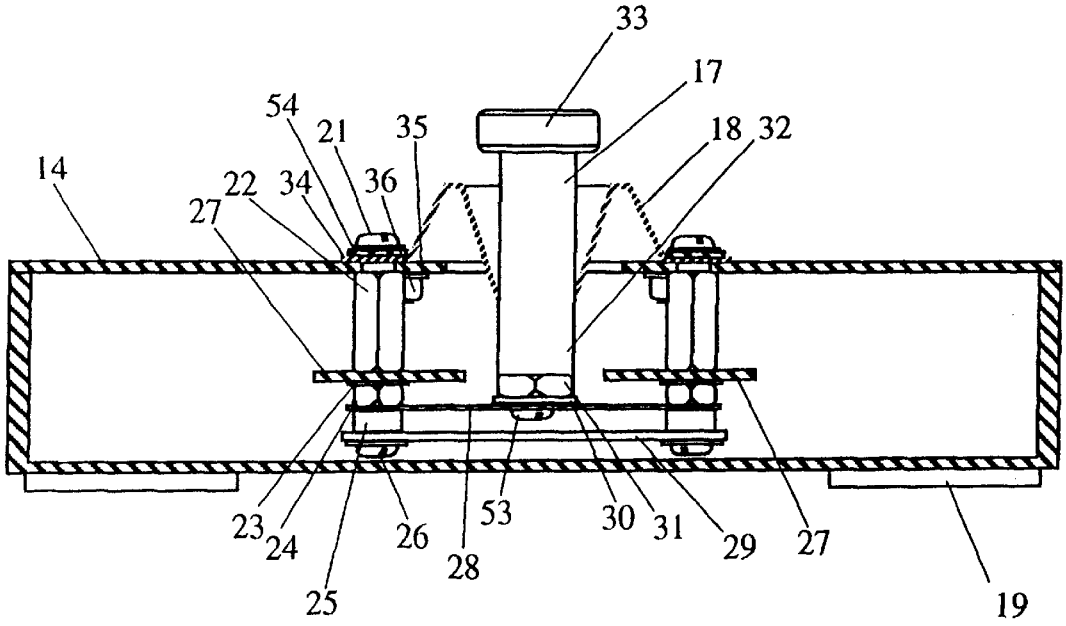
FIG. 4 illustrates in cross section the first preferred embodiment illustrated in FIG. 3.
Figure 7:
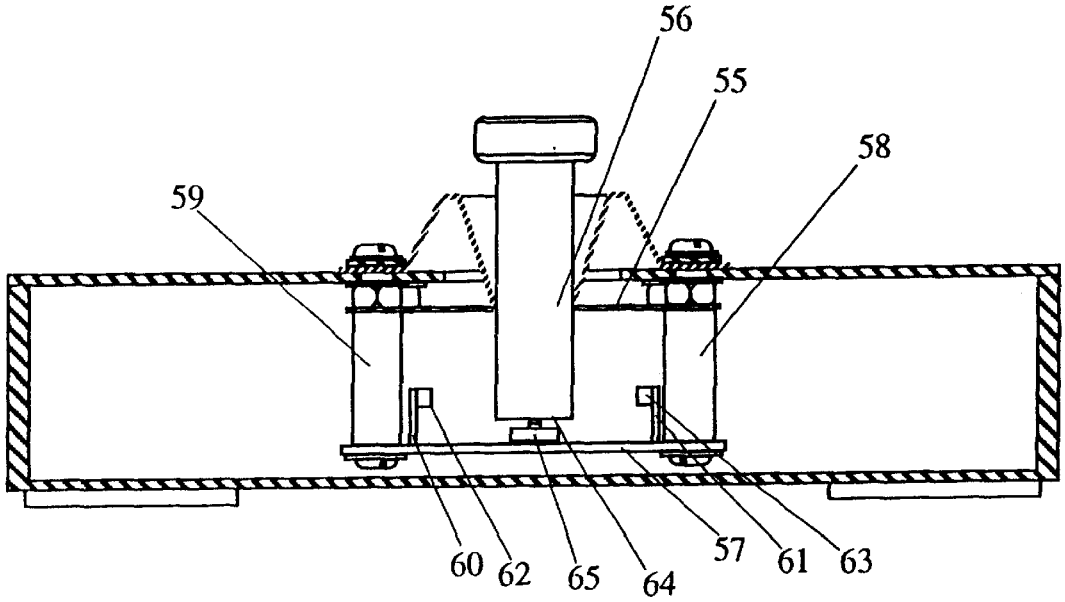

In cross section, along A–A', the joy stick 17 is shown in more detail in FIG. 4. Suspended from the top surface of the box 14 is the joystick 17 and its mountings. The suspension arrangement includes top bolt 21, top long nut 22, washer 23, PCB nut 24 bottom long nut 25 and lower bolt 26. This suspension arrangement supports an optical section printed circuit board 27, a four legged flat spring 28 and a button printed circuit board 29.

Upon the board 27 are four LED's and four phototransistors arranged to produce two pairs of beams each pair being substantially at 90° to the other. This is generally as described above in reference to FIG. 1.

The joy stick 17 includes an opaque internally threaded cylindrical member 32. A bolt 53 with washer 30 and nut 31 is secured to the spring 28, and the member 32 is screwed onto the bolt 53. To the other end of member 32 is screwed in a knurled knob 33 which is suited to manual manipulation. The spring 28 permits the joy stick 17 to be rotated side to side.

The boot 18 snugly fits about the joys stick 17 and is fitted to the box 14 with gasket 54, washer 34 and upper bolt 21 and further washer 35, nut and bolts 36. This is arranged to provide a flexible seal restricting ingress of contaminants into the box 14.

It will be appreciated that in an electrically hostile environment such as a dusty, damp or corrosive, an effective seal preventing ingress of such contaminants can increase the effective life of the device. Some previously known devices have not been conveniently and effectively sealed to such an environment so limiting their use.

FIG. 4 does not show a push button below the spring 28 and the joystick 17. However, if desired and with suitable selection of spring 28 axial movement of the joystick 17 can be permitted. Such movement can bring the lower part of the spring 28 to bear against and actuate a push button. This permits movement of the joystick to effect a mouse click.

Figures 5A, 5B, 5C, 5D:
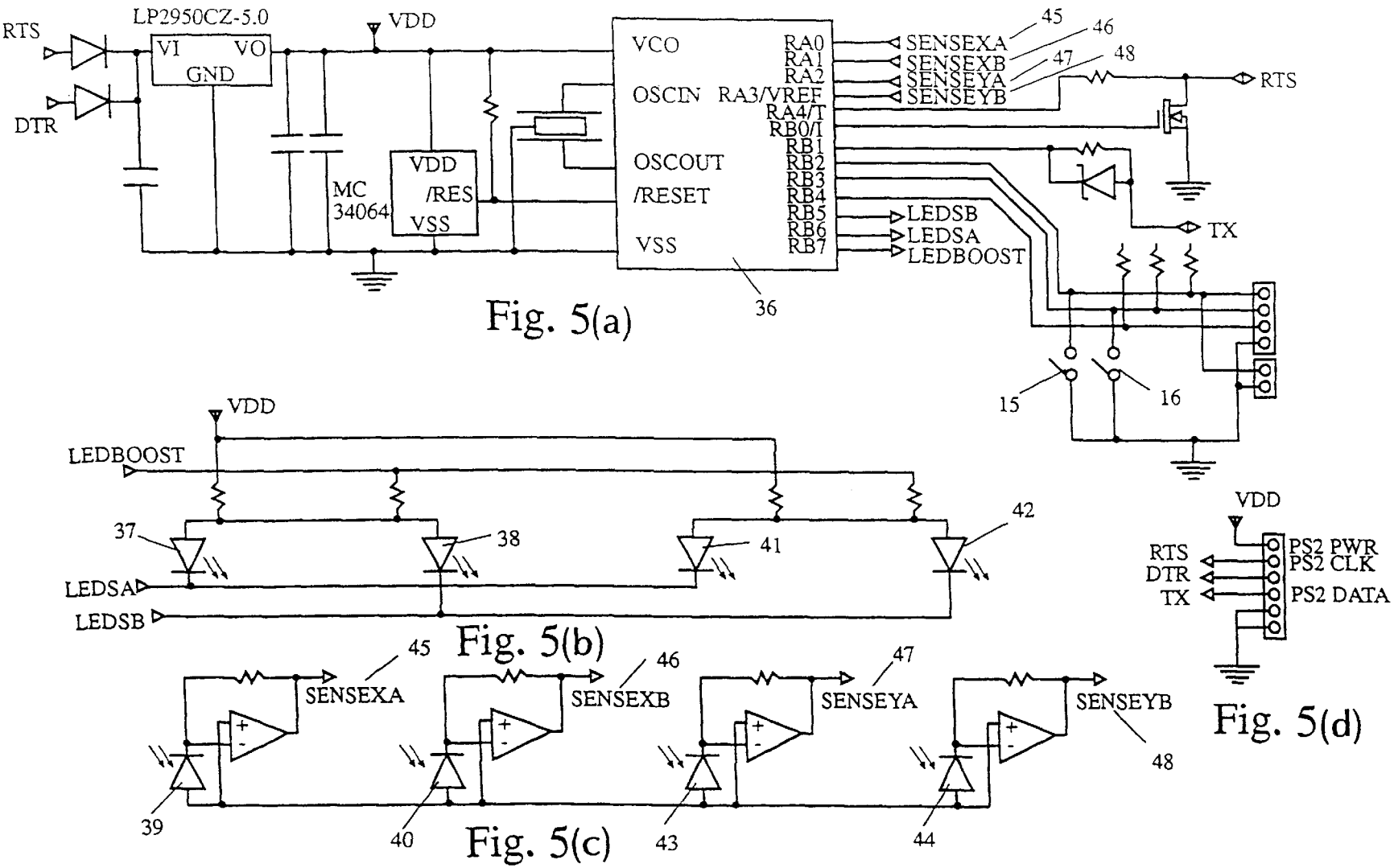
FIG. 5 is a further electronic schematic drawing of the first preferred embodiment.
Figure 6A:
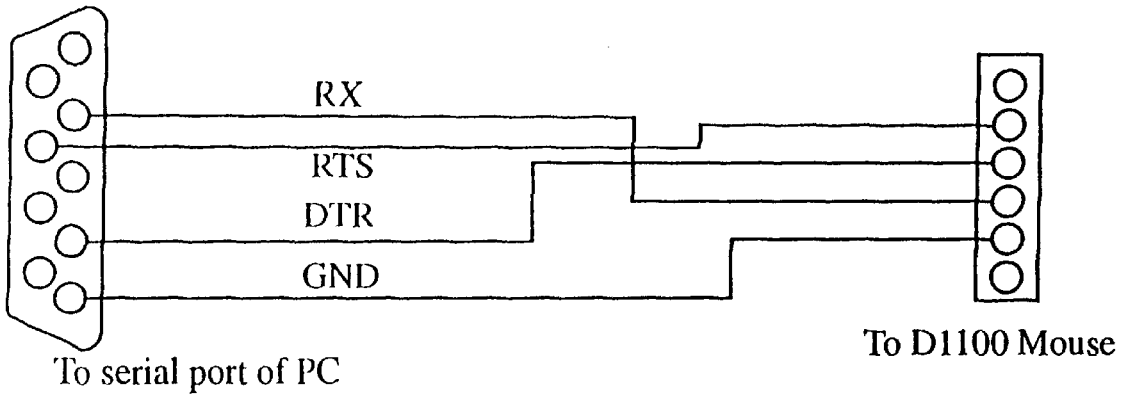
FIG. 6 is an electronic schematic drawing of the first preferred embodiment; and, FIG. 7 illustrates in cross section a second preferred embodiment
Figure 6B:
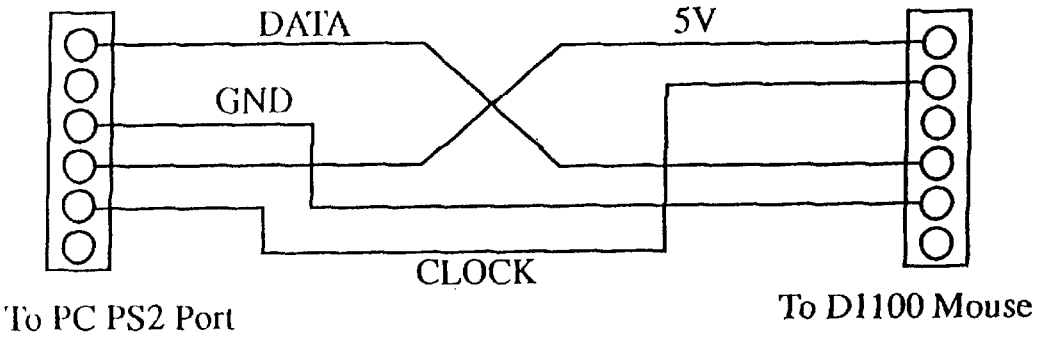

Turning to the electronic schematic drawings of FIGS. 5 and 6. In FIG. 6 serial mouse, or device computer connection details and mouse button details are shown.

On optical board 27 the components of FIG. 5 are mounted. The heart of the processing of the joy stick movement is conducted in micro controller 36. This provides serial transmit and receive signal processing allowing the device to communicate with a computer. This is provided by generally known techniques that a skilled addressee would understand and know. Appendix 1 provides a source code listing of the micro controller 36 program code.

LED's 37 and 38 have configuration about the joystick to provide counter direction beams which provide the X axis. These are directed to photo diodes 39 and 40 respectively. In a similar manner LED's 41 and 42, photo diodes 43 and 44 are arranged and provide the Y axis.

The signals from the photo diodes are conditioned by operational amplifiers to provide respective output signals 45, 46, 47 and 48. These are supplied to the micro controller 36 which performs analog to digital conversion of these signals.

Software permits the micro controller to perform turn on calibration of the output signals 45, 46, 47 and 48 so that with the joystick in a central position variation in component characteristics can be allowed for. That is, each signal has a respective central joystick output value which may vary from the that of other signals. This central joystick output value is used to effectively calibrate the device. In this manner the device may perform at start up auto zeroing and calibration as well as diagnostic checks.

Under software control the micro controller repeatedly turns on LEDS 37, 38, 41 and 42, samples the output signals 45, 46, 47 and 48, adjusts for calibration factors, subtracts resultant value for output signal 45 from 46 to form a positive or negative value corresponding to the X axis desired direction. The sign of the result is used to set flag indicating X direction whilst the magnitude is used to select an output value, represented by a predetermined number of bits, from a look up table of a number of values indicating the desired speed of movement.

Likewise this signals 47 and 48 are processed. These results, now conforming to known mouse standards are transmitted to the computer for control of the cursor on a display.

It will be appreciated from the source code of Appendix 1 and also common knowledge regarding practice with micro controllers that diagnostic, expanded and dynamic control functions can be accommodated in a system. The source code and schematics illustrate some of these which a skilled addressee would appreciate and understand as not being essential to a conceptual understanding of the invention. For example, if a detected light level is low it may be desirable to increase light source power to ensure wide applicability of the invention as exhibited by a particular embodiment. In a similar manner diagnostic check may be made to ensure the system of a particular embodiment is fully operable.

The second embodiment illustrated in FIG. 5 is very similar to the first embodiment just described. Only the differences will be discussed. The second embodiment has the joy stick or elongate member, supported by a flat spring 55 part way along its length at 56. The spring and printed circuit board 57 are supported by supports such as 58 and 59. On stands 60 and 61 LEDs 62 and phototransistors 63 are mounted to the printed circuit board in a configuration as previously explained. As can be seen the end 64 of the joy stick transverses and intersects the beams or paths between LEDs 62 and phototransistors 63. Also mounted to the printed circuit board is push button 65 which is beneath end 64 of the joy stick. By depressing the joy stick the push button can be activated by the end 64 of the joy stick.

The second embodiment has the advantage of reducing the required number of printed circuit boards. This can reduce manufacturing costs.

It will be appreciated that this disclosure is not intended to limit the invention to preferred embodiments or details thereof. It is intended to give an overview of the invention as conceived the details of which, at time of writing, are still be investigated.

A skilled addressee would readily appreciate that various electronic circuitry could be used to effect the invention. For example, whilst the preferred embodiment utilises A/D conversion and subsequent processing circuitry is easy to conceive that would comparison of the analogue signal form the detectors to produce signals indicative a desired direction of cursor movement.

APPENDIX 1

Micro controller source code

```
list P=16C71, C=120, N=100, E=1, R=DEC
        title "(C) APC Services Australia 1996, Optical Joystick Mouse"
;ÚÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄ¿
;"APC Optical Joystick Mouse I/F                                  "
;"The new generation 1995                                         "
;"(C)APC Services Pty Ltd Australia                    "
;ÀÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÄÙ
        include "macro.asm"
        include "d1100.mac"
        include "dae71.equ"
;
;       Version         Version Under Development
;
;       Revisions
;
;       19 Feb 96       Adjusted speeds upwards by adjusting table and speed
;               Power up with middle button down causes special diagnostic
;               data to be sent up serial port
;       13 Mar 96       Added compile time option that allows x and y axis to be swapped
;               and x and y polarities to be swapped.
;               Created a version with axis rotated 90 degrees by
;               swapping axis and inverting Y axis
;       18 Mar 96       Inverting Y axis is wrong move. Changed to inverting X axis
;               to make change of 13 Mar 96 effective
;       18 Mar 96       Changed scale_trip to 150
;
;       I/O Pins defined bit by bit
                bequ buttonm,portb,4            ;Middle button active low
                bequ buttonr,portb,3            ;Right hand button. Active low
                bequ buttonl,portb,2            ;Left hand button. Active low
                bequ tx,portb,1                 ;serial transmitt line OUT
                bequ rts,porta,4                ;serial Hand Shake line in RTS
                bequ ledsa,portb,6              ;active low. Leds pointing to A
                bequ ledsb,portb,5
                bequ ledsboost,portb,7          ;active high and out. Increases power level
```

APPENDIX 1-continued

Micro controller source code

```
                bequ.ledsboostd,dirb,7          ;direction control bit
;
;       Compile time options
;       X and Y axis swap
swapxy          equ   true
a       Invert x and y axis
invertx         equ   true                      ;a true value inverts polarity of X axis
inverty         equ   false                     ;............................ Y axis
;
;       Configuration Constants
;       Serial port (normal mode)
no_of_tx_bits equ       7                               ;number of bits per byte on the serial port
no_of_tx_wait equ       205                     ;1200 Baud
;       Serail port (fast mode)
no_of_tx_bits_f equ     8                               ;number of bits per byte on the serial port
no_of_tx_wait_f equ     49                      ;4800 Baud
;
no_samples      equ     4                               ;number of A/D reads accumulated
scale_trip      equ     150                     ;level at which high and low range are swapped
speed   equ     4                               ;speed factor. 1 is fastest. 63 is slowest
;
;       registers
;       General Purpose Variables
count   equ     ram             ;general purpose counter
count1          equ     ram+1
wait_count_1 equ        ram+2
wait_count_h equ        ram+3
flags       equ  ram+15                         ;assorted flages
                bequ sign,flags,0;keep track of sign during maths
                bequ fast_serial,flags,1        ;set for fast serial comms
;       Serial Related Variables
tx_acca         equ     ram+4                   ;byte being shifted out to serial port
tx_count        equ     ram+5                   ;counter of bits being shifted out serial port
;
;       Math routine variables
arga    equ     ram+6
argb    equ     ram+7
arg_h   equ     ram+8
arg_l   equ     ram+9
acca    equ     ram+10
acca_h          equ     ram+11
acca_l  equ     ram+12
rem_h   equ     ram+13
rem_l   equ     ram+14
;
levela_h        equ     ram+16                  ;A/D readings x no_samples
levela_l        equ     ram+17                  ;for A sensors (opposit leds A)
levelb_h        equ     ram+18                  ;A/D readings x no_samples
levelb_l        equ     ram+19                  ;For B sensors
zero_z          equ     ram+20                  ;Zero reading to be used for next calc
zero_x          equ     ram+21                  ;Zero reading X axis
zero_y          equ     ram+22
acca_x_l        equ     ram+23                  ;Accumulated movement
acca_y_l        equ     ram+24
acca_x_h        equ     ram+25
acca_y_h        equ     ram+26
move_x          equ     ram+27                  ;movement to be made next report
move_y          equ     ram+28
buttons         equ     ram+29                  ;new button positions
buttons_old     equ     ram+30                  ;previously reported button positions
;
;       Reset
;
                org     reset
                goto start
;
                org     program
;
        Include "math.asm"
;
;       Execution starts here
;       Set up port directions
start   bank 0                                  ;set I/O lines to safe state before setting as
                movlf01100000b,portb;as outputs
                bank 1                          ;set directions
                movlf11010110b,pot;set up the timer (clocks over ever 32ms)
                movlf11111111b,dira ;Highs are inputs
```

APPENDIX 1-continued

Micro controller source code

```
                movlf10011100b,dirb
                bank0
                clrf flags
;       Power up delay for supplies to settle
set_zero        for     wait_count_h,100        ;wait 200ms
                pause 2000,wait_count_l
                next wait_count_h
;       Set up A/D scaling
                bank 1
                bclr ledsboostd                 ;set LED tx level to high
                bank 0
                bset ledsboost
                bclr ledsa
                pause 500,wait_count_l          ;wait for signal to get through amps
                call readxa                     ;get a reading
                addlw 255-scale_trip ;is        too high to use boost ?
                reading
                bc      no_boost                ;too high for boost
                call readya                     ;get a reading
                addlw 255-scale_trip ;is reading too high to use boost ?
                bc      no_boost                ;too high for boost
                bset ledsa
                bclr ledsb
                pause 500,wait_count_l          ;wait for signal to get through amps
                call readxb                     ;get a reading
                addlw 255-scale_trip ;is reading too high to use boost ?
                bc      no_boost                ;too high for boost
                call readyb                     ;get a reading
                addlw 255-scale_trip ;is reading too high to use boost ?
                bc      no_boost                ;too high for boost
                bset ledsb                      ;switch leds off
                goto boost
;
no_boost        bank 1
                bset ledsboostd                 ;switch boost off
                bank 0
boost
;       Has diagnostic mode been selected by holding middle button down
                brclr buttonm,diagnostic
;       Record Zero position
;       zero movement accumulators
                pause 2000,wait_count_l         ;wait for supplies to recover
                call readx                      ;get zero reading
                call dif
                movff acca_l,zero_x ;store
                reading
                call ready                      ;get zero reading
                call dif
                movff acca_l,zero_y ;store
                reading
;
                clrf acca_x_h                   ;clear x movement accumulator
                clrf acca_x_l
                clrf acca_y_h                   ;clear y movement accumulator
                clrf acca_y_l
;
;       Preset button information
                clrf buttons_old
;
;       M A I N P R O G R A M L O O P
;
main_loop
;       Read and crunch X axis
                call readx                      ;read a axis
                movff zero_x,zero_z
                call crunch
                clrf acca_l
                andlw 0ffh                      ;if displacement is zero skip all this
                bz      skip_x
                btclr sign                      ;Handle sign
                sublw 0
                addwf acca_x_l,same ;add new displacement to accumulation
                skpnc
                incf acca_x_h,same
                btclr sign
                decf acca_x_h,same ;if result was - MSB would have been ffh
                movff acca_x_h,acca_h ;divide acculumation by speed
```

APPENDIX 1-continued

Micro controller source code

```
                movff acca_x_l,acca_l
                movlf speed,arg_l
                clrf arg_h
                call divcap
                brclr sign,pos_x10
                movfw rem_l             ;don't try to negate zero
                iorwf rem_h,w
                bz      pos_x10
                comf rem_l,same         ;correct sign of remainder
                incf rem_l,same
                skpnz
                decf rem_h,same
                comf rem_h,same
pos_x10         movff rem_h,acca_x_h ;remainder is residual accumulated counts
                movff rem_l,acca_x_l
skip_x          movff acca_l,move_x ;record for mext report
;
;       Read and crunch y axis
                call ready              ;read a axis
                movff zero_y,zero_z
                call crunch
                clrf acca_l
                andlw 0ffh              ;if displacement is zero skip all this
                bz      skip_y
                btclr sign              ;Handle sign
                sublw 0
                addwf acca_y_l,same;add new displacement to accumulation
                skpnc
                incf acca_y_h,same
                btclr sign
                decf acca_y_h,same;if result was - MSB would have been ffh
                movff acca_y_h,acca_h ;divide accumulation by speed
                movff acca_y_l,acca_l
                movlf speed,arg_l
                clrf arg_h
                call divcap
                brclr sign,pos_y10
                movfw rem_l             ;don't try to negate zero
                iorwf rem_h,w
                bz      pos_y10
                comf rem_l,same         ;correct sign of remainder
                incf rem_l,same
                skpnz
                decf rem_h,same
                comf rem_h,same
pos_y10         movff rem_h,acca_y_h;remainder is residual accumulated counts
                movff rem_l,acca_y_l
skip_y          movff acca_l,move_y
;
;       Put button bits together report if changed
                clrf buttons
                btset buttonI
                bsf     buttons,5
                btset buttonr
                bsf     buttons,4
                movfw buttons
                subwf buttons_old,w
                bnz     report
;       if movement has occured report
                movfw move_y            ;is there any movement to report
                iorwf move_x,w
                bz      skip_report
;       Update record of old buttons
report movff buttons,buttons_old
;       pack first byte 1 1 L R Y7 Y6 X7 X6
                movlw 11000000b
                btfsc move_y,7
                iorlw 00001100b
                btfsc move_x,7
                iorlw 00000011b
                iorwf buttons,w         ;include button reports
                movwf tx_acca
                call tx_byte
;       pack second byte 1 0 X5 . . . . . X0
                movfw move_x
                andlw 00111111b
                iorlw 10000000b
```

APPENDIX 1-continued

Micro controller source code

```
                movwf tx_acca
                call tx_byte
;       pack third byte 1 0 Y5 . . . . . . . Y0
                movfw move_y
                andlw 00111111b
                iorlw 10000000b
                movwf tx_acca
                call tx_byte
skip_report
;       Wait until it is the next cycle time
cycle_wait      brclr rts,signon            ;do we need to do a M signon
no_signon                                   ;re enter here if it was false alarm
                movf rtcc,w                 ;wait for counter to be zero
                bnz     cycle_wait
cycle_wait1     movf rtcc,w                 ;wait for counter to not be zero
                bz      cycle_wait1
                goto main_loop
;
;
;       Performs the sign on operation (sending capital M)
;       Then restarts SW at set_zero point
signon          for     wait_count_h,10 ;do we really need to sign on ?
                brset rts,no_signon ;false alarm
                next wait_count_h
signon_loop     brclr rts,signon_loop ;wait for end of reset command
                movlf 4dh,tx_acca           ;send the magic number
                call tx_byte
                goto set_zero
;
;
;       Diagnostic mode
diagnostic      bset fast_serial            ;set serial comms to higher speed & 8 bits
                movlw 080h                  ;diagnostic mode indicator
                brset buttonr,diagnostic_10 ;report button states
                iorlw 0001b
diagnostic_10 brset buttonm,diagnostic_20 ;report button states
                iorlw 0010b
diagnostic_20 brset buttonl,diagnostic_30 ;report button states
                iorlw 0100b
diagnostic_30 movwf tx_acca
                call tx_byte
                call readx                  ;send up x data
                movff levela_h,tx_acca      ;send up A/D reading for x axis
                call tx_byte
                movff levela_l,tx_acca      ;send up A/D reading for x axis
                call tx_byte
                movff levelb_h,tx_acca      ;send up A/D reading for x axis
                call tx_byte
                movff levelb_l,tx_acca      ;send up A/D reading for x axis
                call tx_byte
                call dif
                movff acca_l,tx_acca        ;send up differential
                call tx_byte
                call ready                  ;send up y data
                movff levela_h,tx_acca      ;send up A/D reading for y axis
                call tx_byte
                movff levela_l,tx_acca      ;send up A/D reading for y axis
                call tx_byte
                movff levelb_h,tx_acca      ;send up A/D reading for y axis
                call tx_byte
                movff levelb_l,tx_acca      ;send up A/D reading for y axis
                call tx_byte
                call dif
                movff acca_l,tx_acca        ;send up differential
                call tx_byte
                for     wait_count_h,100    ;wait 200ms
                pause 2000,wait_count_l
                next wait_count_h
                goto diagnostic
;
;       Routine that takes the differential of level_a and level_b,
;       corrects for the zero value in zero_z, and looks up a table.
;       result of table look up in w. Sign in sign flag (set for <0)
;
crunch          call dif        ;calculate differ-
                ential
                movfw zero_z                ;do zero adjust
```

APPENDIX 1-continued

Micro controller source code

```
                subwf acca_l,same
                bclr sign                   ;record sign
                btfss acca_l,7
                goto crunch 10              ;number is positive
                bset sign                   ;number is negative. Flag it
                comf acca_l,same            ;negate to make number positive
                incf acca_l,same
crunch 10       movfw acca_l                ;cap number to length of table
                addlw 255-(table_length-1)
                bnc     crunch20            ;value already in range
                movlf (table_length-1),acca_l;value was too big. Cap value
crunch20        movfw acca_l                ;look up value in the table
                goto look_up                ;look up value in table that must be in
                                            ;known page
;       Routine that takes the differential of level_a and level_b
;       dif=(32*(b-a))/(a+b)
;       result in acca_l (8 bit result only)
dif     clrf acca_h
                movfw levelb_l              ;calculate levela-levelb
                subwf levela_l,w
                movwf acca_l                ;build result in dividend
                skpc
                decf acca_h,same
                movfw levelb_h
                subwf levela_h,w
                addwf acca_h,same
;       multiply a−b × 32
dif10   for     count,5                     ;rotate left 5 times
                bcf     status,carry
                rlf     acca_l,same
                rlf     acca_h,same
                next count
;       calculate a+b
                clrf arg_h
                movfw levela_l
                addwf levelb_l,w
                movwf arg_l
                skpnc
                incf arg_h,same
                movfw levela_h
                addwf levelb_h,w
                addwf arg_h,same
;
;       Structure Schmucture
;       this part is also called as a routine that
;       Does a dividion where acca is signed and arg in positive
;       result is 8 bit signed in acca_l and capped to +/− 63
divcap
;       record and correct sign
                bclr sign                   ;set sign to positive
                btfss acca_h,7              ;is dividend negative ?
                goto dif30
                bset sign                   ;make a note that sign of result is -
                comf acca_l,same            ;negate the dividend
                incf acca_l,same
                skpnz
                decf acca_h,same
                comf acca_h,same
dif30
;       divide by a+b
                call dvu1616
                movfw acca_h                ;only use LSB of acca
                bnz     difcap
                movfw acca_l                ;cap result to +/− 6 bits
                addlw 64
                bnc     dif20
;
difcap movlf 63,acca_l                      ;put largest value in acca
                clrf acca_h
dif20   brclr sign,dif_return ;adjust sign of result to be the
                comf acca_l,same            ;negate (lower 8 bits only used)
                incf acca_l,same
dif_return      return
;
;       Routine that totals several measurements of the A/D X axis
readx   if      invertx=true
                bclr ledsb
```

APPENDIX 1-continued

Micro controller source code

```
        else
        bclr
        ledsa
        endif
        clrf    ;clear accumulation of total
        leve-
        la_l
        clrf
        leve-
        la_h
        movlf   ;set up counter of readings
        no_samples,count
        pause   ;wait for signal to get through amps
        500,
        wait-
        _count_l
readxa_loop     pause 100,wait_count_l
                if      swapxy=false
                if      invertx=true
                call readxb
                else
                call readxa                     ;take a reading
                endif
                else
                if      invertx=true
                call readyb
                else
                call readya                     ;take a reading
                endif
                endif
                addwf levela_l,same ;add
                reading
                skpnc
                incf levela_h,same
                decfsz count,same
                goto readxa_loop
;
                if      invertx=true
                bset ledsb
                bclr ledsa
                else
                bset ledsa
                bclr ledsb
                endif
                clrf levelb_l                   ;clear accumulation of total
                clrf levelb_h
                movlf no_samples,count          ;set up counter of readings
                pause 500,wait_count_l          ;wait for signal to get through amps
readxb_loop     pause 100,wait_count_l
                if      swapxy=false
                if      invertx=true
                call readxa
                else
                call readxb                     ;take a reading
                endif
                else
                if      invertx=true
                call readya
                else
                call readyb                     ;take a reading
                endif
                endif
                addwf levelb_l,same ;add
                reading
                skpnc
                incf levelb_h,same
                decfsz count,same
                goto readxb_loop
                bset ledsb
                bset ledsa
                return
;
;       Routine that totals several measurements of the A/D Y axis
ready   if      inverty=true
                bclr ledsb
                else
                bclr ledsa
                endif
```

APPENDIX 1-continued

Micro controller source code

```
                clrf levela_l                   ;clear accumulation of total
                clrf levela_h
                movlf no_samples,count          ;set up counter of readings
                pause 500,wait_count_l          ;wait for signal to get through amps
readya_loop     pause 100,wait_count_l
                if      swapxy=false
                if      inverty=true
                call readyb
                else
                call readya                     ;take a reading
                endif
                else
                if      inverty=true
                call readxb
                else
                call readxa                     ;take a reading
                endif
                endif
                addwf levela_l,                 same ;add reading
                skpnc
                incf levela_h,same
                decfsz count,same
                goto readya_loop
;
                if      inverty=true
                bset ledsb
                bclr ledsa
                else
                bset ledsa
                bclr ledsb
                endif
                clrf levelb_l                   ;clear accumulation of total
                clrf levelb_h
                movlf no_samples,count          ;set up counter of readings
                pause 500,wait_count_l          ;wait for signal to get through amps
readyb_loop     pause 100,wait_count_l
                if      swapxy=false
                if      inverty=true
                call readya
                else
                call readyb                     ;take a reading
                endif
                else
                if      inverty=true
                call readxa
                else
                call readxb                     ;take a reading
                endif
                endif
                addwf levelb_l,same ;add reading
                skpnc
                incf levelb_h,same
                decfsz count,same
                goto readyb_loop
                bset ledsb
                bset ledsa
                return
;
;       Routines that Read the A/D
;
;       These routines each read an A/D channel
readxa          readad 0,0                      ;read channel 0, VDD as ref
                return
readxb          readad 1,0                      ;read channel 1, VDD as ref
                return
readya          readad 2,0                      ;read channel 2, VDD as ref
                return
readyb          readad 3,0                      ;read channel 3, VDD as ref
                return
;
;       Routine to send bytes on serial port
;               The byte is in tx_acc
;
tx_byte         bset tx     ;send start bit
                call tx_wait                    ;wait 1 bit of time
                movlf no_of_tx_bits,tx_count ;set up counter of bits to tx
                brclr fast_serial,tx_loop ;different number of bits in fast mode
```

APPENDIX 1-continued

Micro controller source code

```
                movlf no_of_tx_bits_f,tx_count
tx_loop         rrf     tx_acca,same ;get the next bit to go
                skpc
                bset tx    ;send a zero
                skpnc
                bclr tx    ;send a one
                call tx_wait
                decfsz tx_count             ;have all the bits gone ?
                goto tx_loop
                bclr tx
                call tx_wait
                goto tx_wait                ;send second stop bit
;
tx_wait         movlf no_of_tx_wait,wait_count_l     ;set up a counter
                brclr fast_serial,tx_wait_loop ;set appropriate speed
                movlf no_of_tx_wait_f,wait_count_l
tx_wait_loop nop
                decfsz wait_count_l
                goto tx_wait_loop
                return
;
;       Last 256 Bytes memory kept apart for Interrupts and lookup tables
;
                org     0300h
;
0       Look up table used by crunch to convert joystick displacement
;       to speed
look_up         bsf     pclath,0
                bsf     pclath,1
                addwf pcl,same
table   retlw 0
                retlw 0
                retlw 0
                retlw 1
                retlw 1
                retlw 1
                retlw 2
                retlw 3
                retlw 4
                retlw 7
                retlw 10
                retlw 13
                retlw 16
                retlw 19
                retlw 22
                retlw 26
                retlw 30
                retlw 34
                retlw 38
                retlw 43
                retlw 48
                retlw 53
                retlw 58
                retlw 63
                retlw 63
                retlw 63
                retlw 63
                retlw 63
end_table
table_length equ        end_table-table
;
                end
```

I claim:

1. A control device for determining displacement of a manipulable member with a longitudinal axis passing along its length, which device comprising:

support means;

a first pair of radiation detectors supported in fixed relationship by the support means and each radiation detector capable of providing an output signal of value dependent upon the intensity of detected radiation;

a first pair of radiation sources supported in fixed relationship by the support means and each radiation source capable of emitting radiation, the first pair of radiation sources capable of irradiating the first pair of radiation detectors, each radiation detector being spaced along a respective one of a first pair of substantially parallel detection paths from a respective one of the radiation sources and receptive to radiation emanating from substantially exclusively the respective one of the radiation sources, the radiation between respective radiation sources and radiation detectors forming a first field of radiation, and each radiation source is adjacent to a radiation detector and distal the other radiation source such that the respective detection paths travel in opposite directions;

the manipulable member being supported by the support means and intersecting the first field of radiation and which in a neutral position the longitudinal axis is substantially centrally located between the detection paths, the manipulable member being an elongate member with a portion suitable for manual manipulation and being opaque to the radiation and movable transverse the first field of radiation and the detection paths thereby capable of variably obstructing radiation emanating from a one of the radiation sources irradiating a respective one of the radiation detectors and thereby varying the level of the output signal of the respective radiation detector; and electronic means connected to and capable of powering the radiation sources, the electronic means being also connected to each of the radiation detectors and capable of processing the outputs of the radiation detectors by a process including the step of subtracting the output signal of one of the first pair of radiation detectors from the output signal of the other of the first pair of radiation detectors to provide a first device output signal.

2. A control device as in claim 1 wherein the first deria output signal takes one of a number of values, greater than two, dependent upon the subtraction of the output signal of one of the first pair of radiation detectors from the output signal of the other of the first pair of radiation detectors.

3. A control device as in claim 2 wherein the sign of the first output signal indicates the direction of movement of the elongate member and the magnitude of the first output signal indicates the extent of the movement of the elongate member.

4. A control device as in claim 1 wherein when the subtraction of the output signal of one of the first pair of radiation detectors from the output signal of the other of the first pair of radiation detectors exceeds a predetermined threshold value then the signal is indicative of desired movement in a respective direction.

5. A control device as in claim 1 wherein the elongate member is supported by the support means in a manner permitting limited lateral movement.

6. A control device as in claim 1 wherein the elongate member is supported by the support means in a manner permitting limited pivotal movement.

7. A control device as in claim 1 wherein the support of the elongate memberrelative to the support means permits axial movement along the longitudinal axis of the elongate member and longitudinal movement of the elongate member in a first direction brings an end of the elongate member to bear against and activate a push button thereby generating a control signal.

8. A control device comprising:

support means;

a first and second pair of radiation detectors supported in fixed relationship by the support means and each radiation detector capable of providing an output signal of value dependant upon the intensity of detected radiation;

a first and second pair of radiation sources supported in fixed relationship by the support means and each radiation source capable of emitting radiation, the first pair of radiation sources capable of irradiating the first pair of radiation detectors, each radiation detector being spaced along a respective one of a first pair of substantially parallel detection paths from a respective one of the radiation sources and receptive to radiation emanating from substantially exclusively the respective one of the radiation sources, the radiation between respective radiation sources and radiation detectors forming a first field of radiation;

the second pair of radiation sources capable of irradiating the second pair of radiation detectors, each radiation detector being spaced along a respective one of a second pair of substantially parallel detection paths from a respective one of the radiation sources and receptive to radiation emanating from substantially exclusively the respective one of the radiation sources, the radiation between respective radiation sources and radiation detectors forming a second field of radiation which is transverse to the to the first field of radiation;

for each pair of radiation sources and radiation detectors each source is adjacent to a detector and distal the other source such that the respective detection paths travel in opposite directions;

a manipulable member with a longitudinal axis passing along its length, the manipulable member being supported by the support means and intersecting the first and second fields of radiation and which in a neutral position the longitudinal axis is substantially centrally located between the first and second detection paths, the manipulable member being opaque to the radiation and movable transverse the first and second fields of radiation and the detection paths thereby capable of variably obstructing radiation emanating from a one of the radiation sources irradiating a respective one of the radiation detectors and thereby varying the level of the output signal of the respective radiation detector; and electronic means connected to and capable of powering the radiation sources, the electronic means being also connected to each of the radiation detectors and capable providing a first device output signal by a process including the step of subtracting the output signal of one of the first pair of radiation detectors from the output signal of the other of the first pair of radiation detectors and providing a second device output signal by a process including the step of subtracting the output signal of one of the second pair of radiation detectors from the output signal of the other of the second pair of radiation detectors.

9. A control device as in claim 8 wherein the manipulable member is an elongate member with a portion suitable for manual manipulation.

10. A control device as in claim 9 wherein the fields are co-planar and transverse one to the other at substantially ninety degrees.

11. A control device as in claim 9 wherein the fields transverse one over the other at substantially ninety degrees.

12. A control device as in claim 9 wherein the elongate member is supported by the support means in a manner permitting limited lateral movement.

13. A control device as in claim 9 wherein the elongate member is supported by the support means in a manner permitting limited pivotal movement.

14. A control device as in claim 9 wherein the support of the elongate member relative to the support means permits axial movement along the longitudinal axis of the elongate member and longitudinal movement of the elongate member in a first direction brings an end of the elongate member to bear against and activate a push button thereby generating a control signal.

15. A control device as in claim 9 wherein the support of the elongate member relative to the support means permits axial movement along the longitudinal axis of the elongate member, the transverse width of the elongate member varies along the length of the elongate member and such longitudinal movement of the elongate member within the fields of radiation effects an alteration in the radiation detected by the detectors and thereby the signals therefrom and the control device output signals produced by the electronic means.

16. A control device as in claim 15 wherein the elongate member has one or more steps in its transverse width along its length.

17. A control device as in claim 15 wherein the control device output signal indicates movement in a represented further dimension.

18. A control device as in claim 9 wherein the support means includes flat spring means supported between spaced portions of the support means transverse to the longitudinal axis of the elongate member, and the elongate member being attached substantially centrally to the flat spring means.

19. A control device as in claim 18 wherein the elongate member is attached by an end to the flat spring means.

20. A control device as in claim 18 wherein the elongate member is attached part way along its length to the flat spring means.

21. A control device as in claim 9 wherein the electronic means includes analog to digital conversion means, digital processor means and digital memory means, each output signal of the radiation detectors being converted by the analog to digital conversion means to a respective digital representation and the digital processor means producing the first device output signal by a process including the step of subtracting the output signal of one of the first pair of radiation detectors from the output signal of the other of the first pair of radiation detectors and the second device output signal by a process including the step of subtracting the output signal of one of the second pair of radiation detectors from the output signal of the other of the second pair of radiation detectors.

22. A control device as in claim 21 wherein the digital processor means produces the first and second device output signals by a process including the step of selecting a value from a look up table dependant upon the respective result of the respective subtractions of the radiation detector outputs.

23. A control device as in claim 21 wherein the support of the elongate member by the support means permits axial movement along the longitudinal axis of the elongate member, the transverse width of the elongate member varies along the length of the elongate member and such longitudinal movement of the elongate member within the fields of radiation effects an alteration in the radiation detected by the detectors and thereby the signals therefrom, the electronic means produces a control device output signal indicative of axial movement of the elongate member by processing the output signals of the radiation detectors in a process including the steps of sampling and storing the representations of the outputs of the radiation detectors, comparing samples of the outputs of the radiation detectors with respective previously stored representations, determining whether the outputs of the radiation detectors have increased or decreased and, if so, producing the control device output signal indicative of axial movement of the elongate member.

24. A control device as in claim 23 wherein the processing of output signals of the radiation detectors by the electronic means includes the step of, when axial movement of the elongate member is determined, summing the representations of the output signals of the radiation detectors and producing the control device output signal indicative of axial movement of the elongate member dependant upon the result of the summation.

* * * * *